US005276985A

United States Patent [19]

Halloran

[11] Patent Number: 5,276,985

[45] Date of Patent: Jan. 11, 1994

[54] DETACHABLE CAP PLAQUE

[76] Inventor: Edward J. Halloran, 111 South Bend Road East, Hamilton, Ontario, Canada, L9A 2B5

[21] Appl. No.: 872,802

[22] Filed: Apr. 23, 1992

[51] Int. Cl.[5] ..... G09F 3/00

[52] U.S. Cl. ..... 40/329; 2/209.13; 2/918; 40/586

[58] Field of Search ..... 2/171, 175, 185; 40/329, 312, 586, 662

[56] References Cited

U.S. PATENT DOCUMENTS

| | | | |
|---|---|---|---|
| Re. 30,958 | 6/1982 | White | 40/312 |
| 780,179 | 1/1905 | Hileman | 2/199 |
| 836,481 | 11/1906 | Brown | 2/199 |
| 2,408,318 | 9/1946 | Josephs | 40/329 |
| 2,517,376 | 8/1950 | Artzt | 40/662 |
| 2,648,847 | 8/1953 | Crowder | 2/199 |
| 2,803,829 | 8/1957 | Tscharner | 2/199 |
| 3,829,995 | 8/1974 | Fakoury | 40/586 |
| 4,179,753 | 12/1979 | Aronberg | 2/199 |
| 4,667,274 | 5/1987 | Daniel | 2/199 |
| 4,985,935 | 1/1991 | Hur | 2/199 |

*Primary Examiner*—Clifford D. Crowder
*Assistant Examiner*—Diana L. Biefeld
*Attorney, Agent, or Firm*—David P. Gordon

[57] ABSTRACT

A detachable plaque for a cap having a visor and an adjoining crown portion is provided. The plaque generally comprises a flexible plastic sheet-like member having a live hinge or crease which defines a boundary between an upper portion of the sheet-like member and the lower portion of the sheet-like member, a first coupling or mating device incorporated on the upper portion of the sheet-like member for detachably engaging a mating member on the crown portion of the cap, and a second coupling or mating device incorporated on the lower portion of the sheet-like member for detachably engaging a second mating member on the visor of the cap. The first and second coupling means may be snaps and/or snap receivers, sockets and/or domed plugs, Velcro hook and/or loop fasteners, etc. In accord with one embodiment of the invention, the flexible plastic sheet has an aperture in at least the upper portion for receiving a piece of cardboard or paper on which a message or information is printed.

11 Claims, 4 Drawing Sheets

FIG. 2
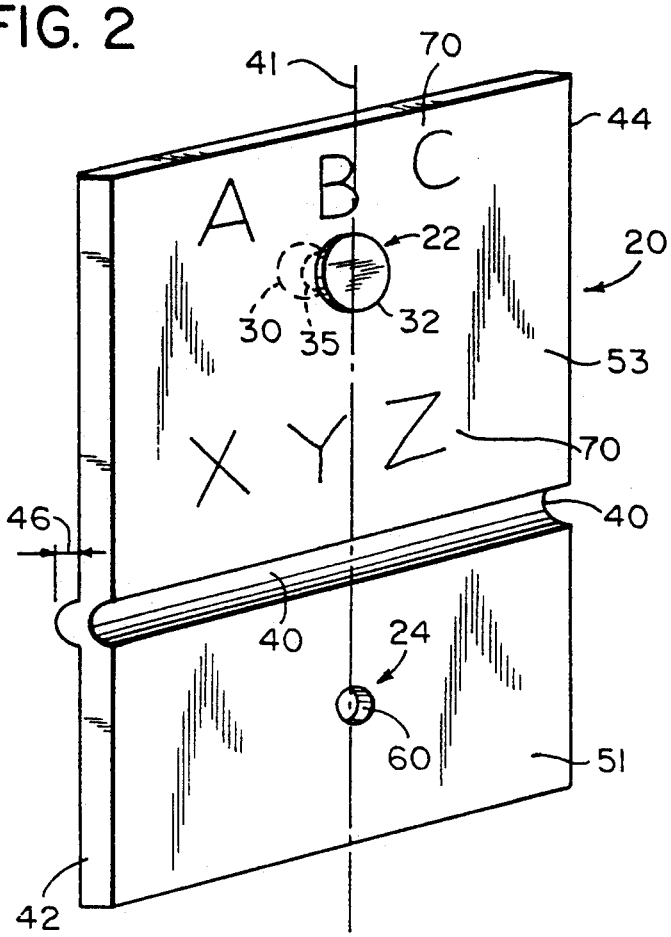
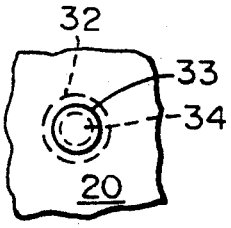
FIG. 2B
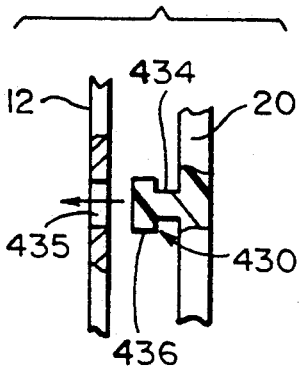
FIG. 2C
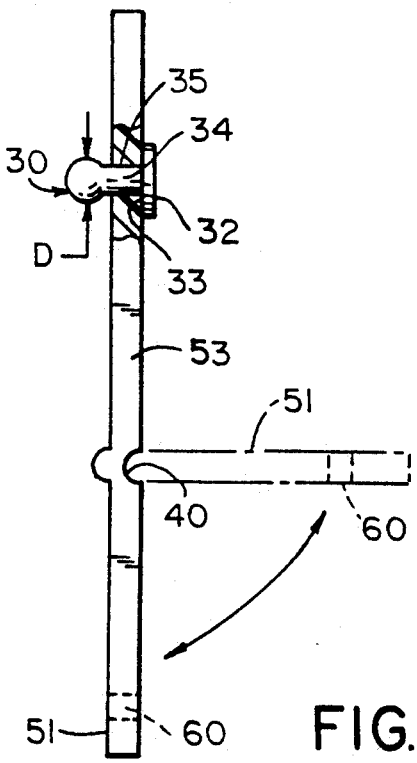
FIG. 2A
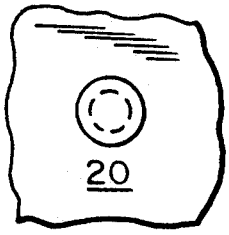
FIG. 2D

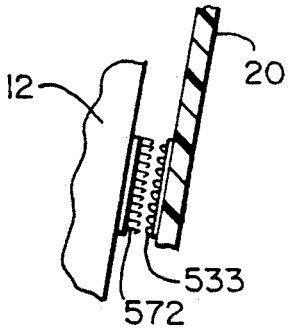
FIG. 5A
FIG. 5B
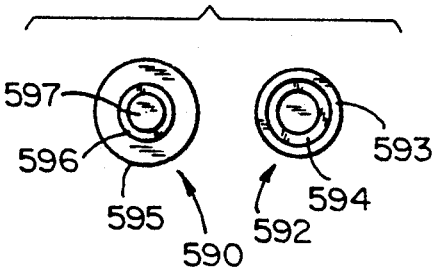
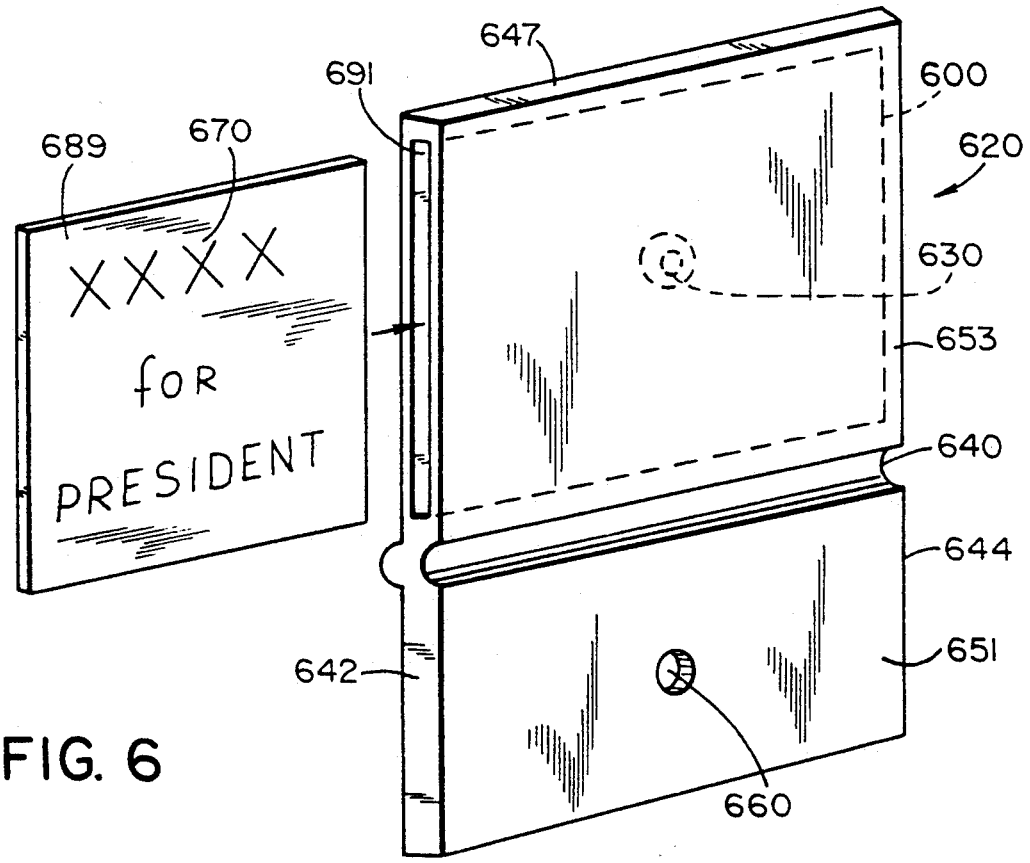
FIG. 6
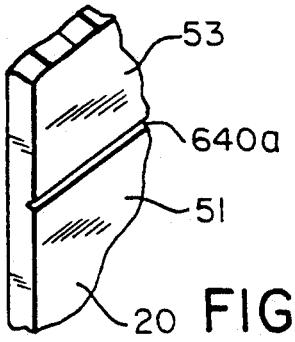
FIG. 6A
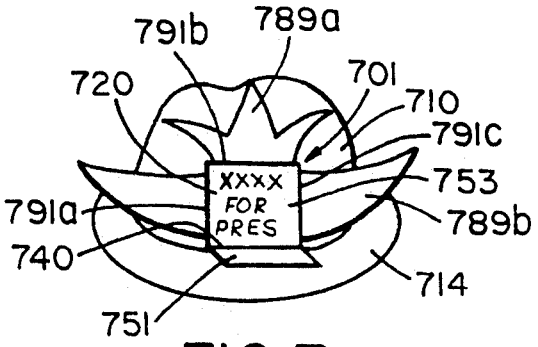
FIG. 7

DETACHABLE CAP PLAQUE

BACKGROUND OF THE INVENTION

The present invention relates broadly to detachable plaques. More particularly, the invention relates to plaques which are suitable for detachably mating with visored caps having mating snaps or other mating means.

Visored caps having a crown portion with a snap receiver and a visor portion having a snap have been well known in the art for some time. The snap receiver and snap are provided in such a fashion that when they are mated together the visor is adjacent the crown, and when they are not mated, the visor assumes a typically perpendicular position relative the crown.

Visored caps without snaps are also well known in the art. The caps are known for numerous purposes, including, but not limited to use in sports, use as an advertising mechanism, use for protection from the sun, etc. Often, printing will be applied to the cap to identify the owner of the cap as belonging to a group, team, organization, etc. While such caps are often relatively inexpensive, should the group, team, or organization wish to change its insignia, or should the owner of the cap wish to change his/her affiliation, there is no recourse but to obtain a new cap and discard the old cap.

SUMMARY OF THE INVENTION

It is therefore an object of the invention to provide a mechanism where a single cap can be used and reused to display different information.

It is another object of the invention to provide a plaque which will work in conjunction with a visored cap having mating mechanisms to display printed information.

In accord with the objects of the invention, a detachable plaque for a cap having a visor and an adjoining crown portion is provided and generally comprises a flexible plastic sheet-like member having a live hinge or crease which defines a boundary between an upper segment of the sheet-like member and the lower segment of the sheet-like member. The flexible member is provided with a first coupling or mating means incorporated in the upper segment or portion of the sheet-like member for detachably engaging a mating member on the crown portion of the cap, and a second coupling or mating means incorporated in the lower segment or portion of the sheet-like member for detachably engaging a second mating member on the visor of the cap. The first and second mating means may be snaps and/or snap receivers, sockets and/or domed plugs, Velcro hook and/or loop fasteners, etc. In accord with one embodiment of the invention, the flexible plastic sheet has an aperture in at least the upper segment for receiving a piece of cardboard or paper on which a message or information is printed.

Additional objects and advantages of the invention will become apparent to those skilled in the art upon reference to the detailed description taken in conjunction with the provided figures.

BRIEF DESCRIPTION OF THE DRAWINGS

FIG. 2 is a perspective view of a plaque in accordance with the present invention prior to attachment to a cap;

FIG. 2*a* is a side elevation view of the plaque of FIG. 2;

FIG. 2*b* is a partial plan view of a portion of the plaque of FIG. 2;

FIG. 2*c* is a partial side elevation view of a further embodiment of the plaque of FIG. 2;

FIG. 2*d* is a partial plan view of the embodiment of FIG. 2*c;*

FIG. 5*a* is a partial side elevation view of a further embodiment of the plaque of FIG. 2 having hook and loop mating means;

FIG. 5*b* is a partial plan view of snap and snap receiver mating means suitable for use with the plaque of FIG. 2;

FIG. 6 is an exploded perspective view of another embodiment of the plaque invention prior to attachment to a cap;

FIG. 6*a* is a partial perspective view of a still further embodiment of the plaques of FIGS. 2 and 6; and FIG. 7 is a perspective view of another embodiment of the plaque invention as attached to a brimmed hat.

DETAILED DESCRIPTION OF INVENTION

Figure 1:
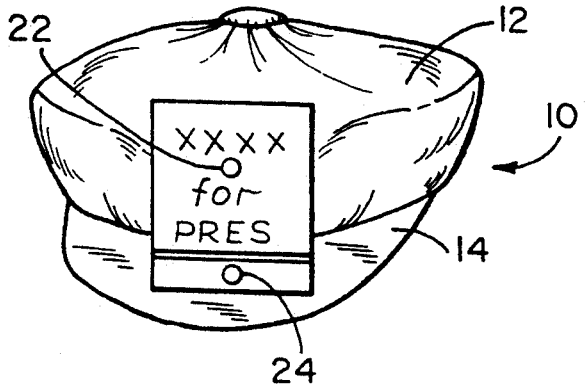
FIG. 1 is a perspective view showing a plaque in accordance with the present invention attached to a visored cap.
Figure 1A:
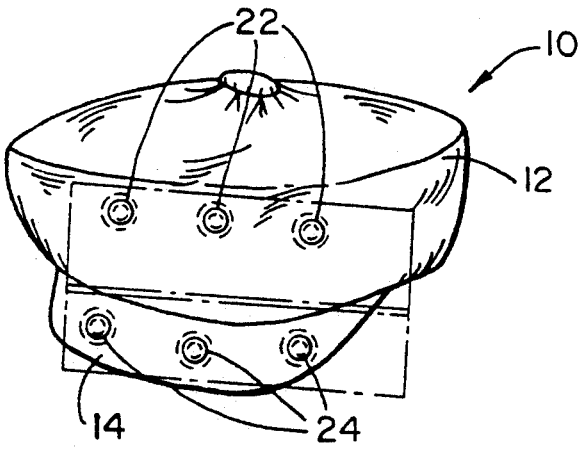
FIG. 1*a* is a perspective view of a visored cap having multiple attachment elements for engagement with a plaque in accordance with the present invention.

With reference to FIG. 1 of the drawings, a visored cap 10 is shown having a crown portion 12 and a visor 14. A flexible plaque 20 is attached to the cap 10 at coupling elements 22, 24. The flexible plaque is suitably made of plastic, cardboard, or light metal. FIG. 1*a* shows an embodiment wherein a plurality of coupling elements 22, 24 are provided to ensure stability of the engagement of plaque 20 to the cap 10.

With reference to FIGS. 2, 2*a*, and 2*b*, a plaque 20, suitably in the form of a rectangular flexible sheet of plastic (e.g., about three inches wide by four inches high), about one-sixteenth to three-sixteenths of an inch thick is provided with a coupling element 22 comprising a dome plug 30 having a flange 32 suitable bonded to sheet-like member 20 at 33. A shaft 34 closely fitted in an aperture 35 formed in the sheet-like member 20 extends through sheet-like member 20 and joins flange 32 to a dome-shaped plug or terminal portion 36 which is wider in diameter "D" than the shaft 34 and aperture 35. Sheet-like member 20 is deformed to provide an arcuate groove or "live hinge" 40 which extends transversely to longitudinal axis 41 across sheet-like member 20 from edge 42 to edge 44 of the sheet-like member. The groove, which is off-set from sheet-like member 20, as indicated at 46 functions as a hinge to enable rotational movement of the lower segment 51 with respect to upper segment 53 of sheet-like member 20. The groove 40 divides the sheet-like member 20 into upper and lower segments 53, 51 and the coupling element 22, described above, is positioned in upper segment 53 and spaced away from groove 40 while coupling element 24 is positioned in lower segment 51 and is also spaced away from groove 40. As shown in FIG. 2, coupling element 24 is an aperture 60 in flexible sheet 20 having a circular cross-section.

Figure 3:
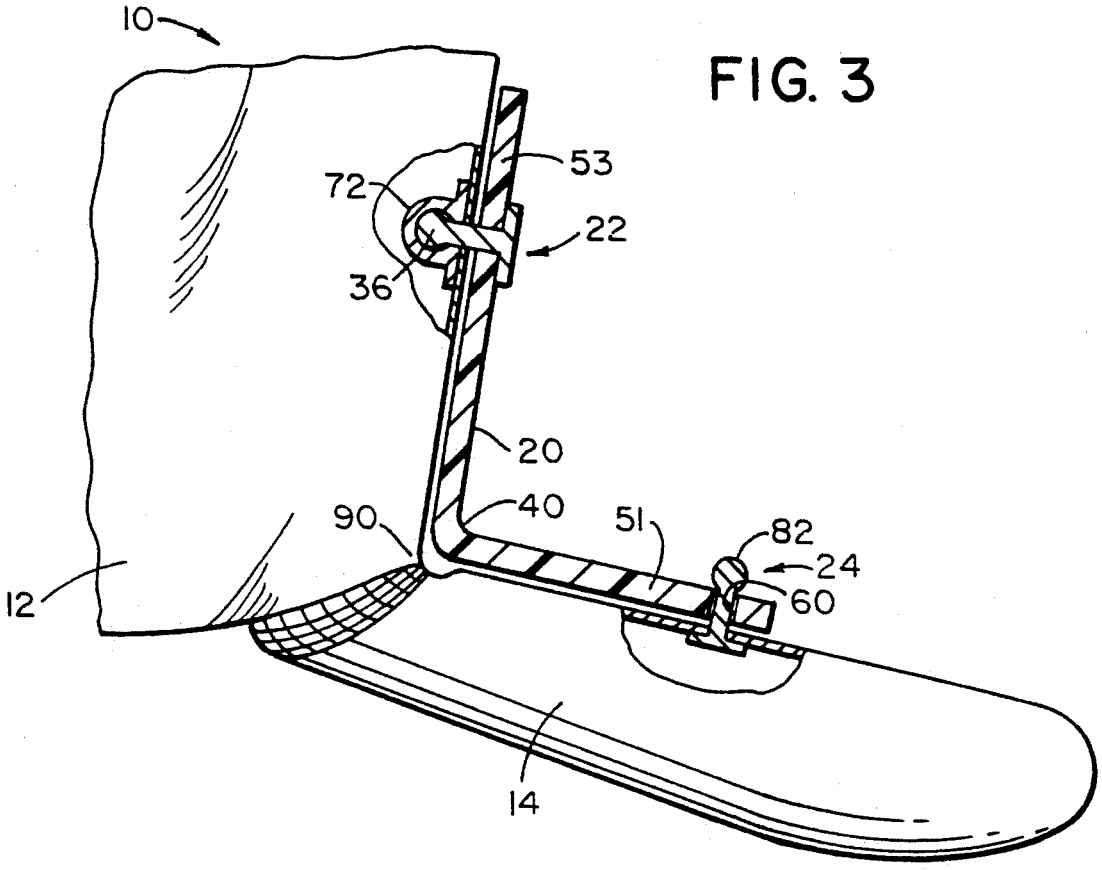
FIG. 3 is a partial side elevation view, partly in section showing a plaque in accordance with the present invention engaged with a visored cap.

In use, visual indicia, e.g., as indicated at 70, are applied to the upper segment 53 of plaque 20, suitably by decal, painting, stamping, or other known techniques. The dome plug 30 of coupling element 22 is engaged, i.e. "snapped" into mating socket of coupling element 72 which is incorporated in crown 12 of cap 10 as seen in FIG. 3. The aperture 60 of coupling element 24 located in lower segment 51 is forced over the dome plug 82 of coupling element 24 which is incorporated in visor 14 of cap 10. It will be appreciated that the socket 72 and dome plug 82 are positioned in the crown 12 and visor 14 to be respectively in register with dome shaped terminal portion 33 and aperture 60 of flexible sheet-like member 20 (and vice versa) when the sheet-like member 20 is bent at groove 40 so that the upper segment 53 of sheet-like member 20 substantially conforms to the adjacent portion of crown 12 and the lower segment 51 of member 20 conforms to the adjacent portion of visor 14 when the groove 40 is positioned closely adjacent the juncture 90 between crown 12 and visor 14.

Figure 4:
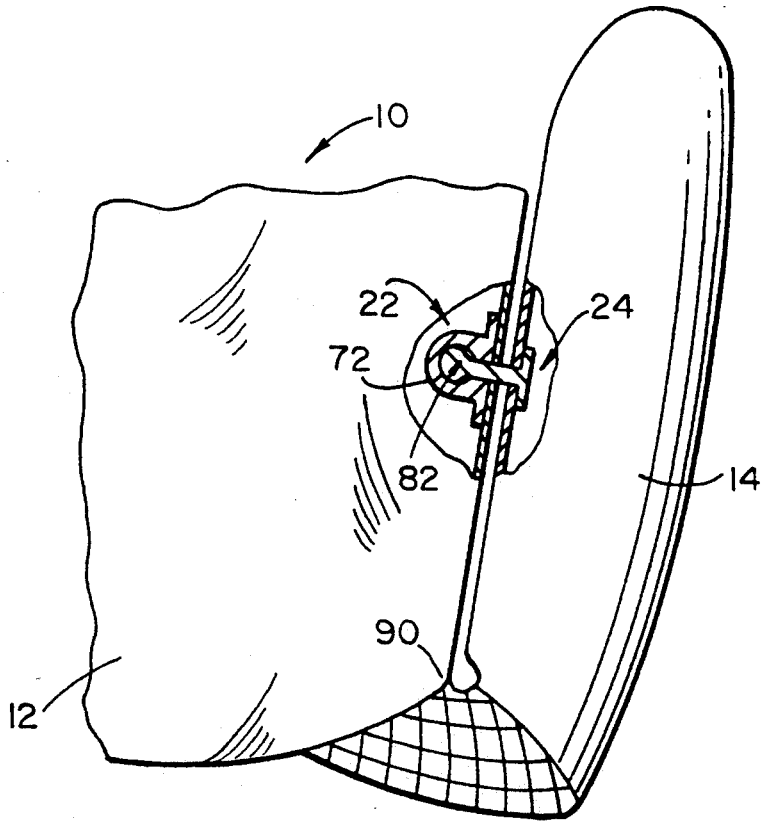
FIG. 4 shows the cap of FIG. 3 without the attached plaque.

FIG. 4 shows visor 14 bent upwardly with its dome plug 82 engaged with socket 72 when the plaque 20 is not in place. The cap 10 may be stored or worn in this condition.

In a further embodiment of the present invention illustrated in FIGS. 2*c* and 2*d*, the dome plug 30 extending through sheet-like member 20 is replace by an asformed portion 430 of flexible sheet 20 which extends perpendicular to sheet 20 and has an enlarged terminal portion 436 which is detachably engageable in an aperture or snap receiver 435 which is incorporated in crown portion 12. It will be appreciated that as with all of the mating arrangements described in the invention, the enlarged terminal portion 436 or its converse (the aperture or snap receiver) may be provided on one or both of upper portion 53 or lower portion 51 or the sheet like member provided the cap is properly arranged. On the other hand, it is preferable that if a male mating member is used on the upper portion of the sheet-like member, a female mating member is used on the lower portion of the sheet-like member, and vice versa, so that the cap will have the ability to have its visor mated to the crown.

Additional mating arrangements are seen in FIGS. 5*a* and 5*b*. In FIG. 5*a*, a hook and loop, i.e., Velcro, coupling arrangement is shown with hooks 572 on the cap, and loops 533 on the flexible sheet-like member 20. The Velcro hooks and loops can be used in replacement of one or all of the coupling arrangements if desired. The use of Velcro tape fasteners allows the plaque of the invention to be used on any hat with a visor or brim regardless or whether the hat was premanufactured with a coupling mechanism. Also, in FIG. 5*b*, a snap 590 and snap receiver 592 are shown and can be used in replacement of one or all of the coupling arrangements. Snap 590 is a standard snap with metal flange portion 595, and a raised (male) inner portion 596. Another concentric raised portion 597 is internal raised portion 596, but is not raised as high as raised portion 596. The snap receiver 592 is likewise a standard snap receiver with outer raised section 593 defining a depressed section 594 into which raised portion 596 of the snap fits. The outer raised section 593 of the snap receiver mates with the raised inner portion 596 of the snap.

Turning to FIG. 6, another embodiment of the plaque invention is seen with sheet-like member 620 having a live hinge 640 defining an upper portion 653 and a lower portion 651. The upper portion has first mating means 630 which can be any of the previously described mating means, while the bottom portion has second mating means 660 which can likewise be any of the previously described mating means. The upper portion 653 of sheet-like member 620, however, is substantially hollow and defines a card-receiving enclosure 600 with an opening or slot 691. Slot 691 is provided on at least one side of the upper portion 653 for the insertion of a card 689 or the like typically made from paper or cardboard with a printed message 670. While slot 691 is shown on side 642 of the sheet-like member 620, it will be appreciated that the slot can be located on side 644, top 647, or even at the live hinge 640. It will also be appreciated that while any of the mating means can be utilized in conjunction with the upper portion 653, preferably, a mating means which does not extend completely through the upper portion 653 is chosen so that the mating means 630 will not interfere with the card receiving opening.

FIG. 6*a* illustrates the use of a crease 640*a* formed in sheet-like member 20 (or 620) in place of a live hinge 40 (or 640) for enabling hinging between upper segment 53 (653) and lower segment 51 (651). This arrangement is useful with relatively thin plaques and can be used in conjunction with the teachings of FIGS. 2 and 6 as well as in conjunction with the teachings of all of the mating arrangements.

Turning to FIG. 7, another embodiment of the plaque invention is seen attached to the brim 714 of hat 710. The plaque 701 has a sheet-like member 720 having a live hinge 740 defining an upper portion 753 and a lower portion 751. The upper portion has first mating means (not shown) which can be any of the previously described mating means, while the bottom portion has second mating means (not shown) which can likewise be any of the previously described mating means. The upper portion 753 of sheet-like member 720, is substantially hollow and is provided with openings or slots 791*a*, 791*b*, and 791*c* on three sides. In this manner, fanciful cards and designs 789*a* and 789*b* typically made from paper or cardboard with or without printed messages can extend beyond the periphery of the plaque itself. The cards 789*a* and 789*b* may be held in place in the hollow upper portion 753 with tape or other means if desired.

There have been described and illustrated herein detachable plaques for visored caps. While particular embodiments of the invention have been described, it is not intended that the invention be limited thereto, as it is intended that the invention be as broad in scope as the art will allow and that the specification be read likewise. Thus, while particular mating means have been disclosed including Velcro loops and hooks, snaps and snap receivers, and domed plug and socket fasteners, it will be appreciated that other mating mechanisms could be utilized. For example, where a hat is not provided with a snap or snap receiver, or a dome or socket fastener, instead of using a simple Velcro arrangement, a Velcro tape may be applied to the visor of the cap and Velcro may also be applied (e.g., glued) to the bottom of the snap, snap fastener, dome, or socket fastener as desired. In this manner, the snap, snap fastener, dome, or socket fastener is held in place and thereby effectively retrofits the cap. Also while certain plastic materials were recommended as being particularly suitable for the flexible sheet-like member, it will be appreciated that other materials could be utilized. It will therefore be appreciated by those skilled in the art that yet other modifications could be made to the provided invention without deviating from its spirit and scope as so claimed.

I claim:

1. A cap for displaying printed materials comprising:
a) a visor;
b) a crown portion joined to said visor at a juncture;
c) a plaque comprised of a flexible sheet-like member having a cease extending from edge-to-edge of said sheet-like member along which said sheet-like member is easily bendable, said crease defining a boundary between an upper portion of said sheet-like member and a lower portion of the sheet-like member;
d) printed material means for display on said upper portion of said sheet-like member;
e) first coupling means incorporated on said upper segment of said sheet-like member and spaced from said crease;
f) second coupling means incorporated on said lower segment of said sheet-like member and spaced from said crease;
g) third coupling means incorporated on said crown portion of said cap, said first and third coupling means being detachably engageable with each other; and
h) fourth coupling means incorporated on said visor, said second and fourth coupling means being detachably engageable with each other, wherein,
said third coupling means is positioned in register with said first coupling means and said fourth coupling means is positioned in register with said second coupling means when said upper portion is closely adjacent said crown portion and said lower portion is closely adjacent said visor and said crease is closely adjacent said juncture between said crown portion and said visor.

2. A cap according to claim 1, wherein:
said upper portion of said sheet-like member has four sides with three edges and said crease defining a fourth side, and said upper portion is substantially hollow with an opening on at least one of said four sides, and said printed material means is located in said substantially hollow upper portion of said sheet-like member.

3. A cap according to claim 2, wherein:
said crease in said plaque is formed by a deformation of said sheet-like member and comprises a live hinge which is offset from the plane of said sheet-like member.

4. A cap according to claim 1, wherein:
said crease in said plaque is formed by a deformation of said sheet-like member and comprises a live hinge which is offset from the plane of said sheet-like member.

5. A cap according to claim 1, wherein:
said first coupling means is one of
a first of a domed plug and a socket fastener and said third coupling means is the other of said domed plug and socket fastener,
a first of a plurality of hooks and a plurality of loop fasteners and said third coupling means is the other of said plurality of hooks and plurality of loop fasteners, and
a first of a snap means and a snap receiver means, and said third coupling means is the other of said snap means and snap receiver means.

6. A cap according to claim 5, wherein:
said upper portion of said sheet-like member has four sides with three edges and said crease defining a fourth side, and said upper portion is substantially hollow with an opening on at least one of said four sides, and said printed material means is located in said substantially hollow upper portion of said sheet-like member, and
said crease in said plaque is formed by a deformation of said sheet-like member and comprises a live hinge which is offset from the plane of said sheet-like member.

7. A cap according to claim 1, wherein:
said crease is a groove formed in said sheet-like member.

8. A cap according to claim 1, wherein:
said sheet-like member is made of plastic and said first coupling means is an integral part of said sheet-like member.

9. A cap according to claim 8, wherein:
said second coupling means is an integral part of said sheet-like member.

10. A cap according to claim 9, wherein:
one of said first coupling means and said second coupling means extends perpendicularly from said sheet-like member and has a terminal portion which detachably engages with one of said third coupling means and said fourth coupling means.

11. A cap according to claim 10, wherein:
said first coupling means is one of
a first of a domed plug and a socket fastener and said third coupling means is the other of said domed plug and socket fastener,
a first of a plurality of hooks and a plurality of loop fasteners and said third coupling means is the other of said plurality of hooks and plurality of loop fasteners, and
a first of a snap means and a snap receiver means, and said third coupling means is the other of said snap means and snap receiver means.

* * * * *